US012320249B2

(12) United States Patent
Qi et al.

(10) Patent No.: US 12,320,249 B2
(45) Date of Patent: Jun. 3, 2025

(54) AUTONOMOUS STOP OF PUMP-DOWN OPERATION

(71) Applicant: Halliburton Energy Services, Inc., Houston, TX (US)

(72) Inventors: Yuan Qi, Houston, TX (US); Sudhir Gupta, Houston, TX (US); Ritesh Dharmendra Panchal, Houston, TX (US); Neil Alan Ostermann, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/543,649

(22) Filed: Dec. 18, 2023

(65) Prior Publication Data

US 2024/0218783 A1 Jul. 4, 2024

Related U.S. Application Data

(60) Provisional application No. 63/436,048, filed on Dec. 29, 2022.

(51) Int. Cl.
*E21B 47/008* (2012.01)
*E21B 23/14* (2006.01)
(Continued)

(52) U.S. Cl.
CPC ..... *E21B 47/008* (2020.05); *E21B 23/14* (2013.01); *E21B 43/121* (2013.01); *E21B 47/024* (2013.01); *E21B 47/09* (2013.01)

(58) Field of Classification Search
CPC ..... E21B 23/14; E21B 47/008; E21B 47/09
See application file for complete search history.

(56) References Cited

U.S. PATENT DOCUMENTS 9,617,814 B2 4/2017 Seals et al.
9,657,540 B2 5/2017 Coles et al.
(Continued)

FOREIGN PATENT DOCUMENTS

WO WO-2021163656 A9 * 10/2021 ..... E21B 23/06

OTHER PUBLICATIONS

International Search Report and Written Opinion for International Patent Application No. PCT/US2023/085266 dated Apr. 16, 2024. PDF file. 8 pages.

(Continued)

*Primary Examiner* — Giovanna Wright
(74) *Attorney, Agent, or Firm* — John Wustenberg; C. Tumey Law Group PLLC

(57) ABSTRACT

Disclosed herein are systems and methods for automating a pump-down stop operation and, more particularly, example embodiments may include an automated pump-down stop system that adjusts a fluid rate and a winch speed before the target depth based on the remaining depth and line speed. An example method for automating a pump-down stop operation of a downhole tool string includes: measuring a depth of the downhole tool string, wherein the downhole tool string is held by a wireline; measuring a wireline tension; measuring a speed of the wireline; measuring a pumping rate; measuring an inclination of the downhole tool string; and regulating automatically a winch controller and a pump controller simultaneously to stop the downhole tool string at a target depth based at least on the measurements of one or more of the depth, wireline tension, speed, pumping rate, and/or inclination.

17 Claims, 10 Drawing Sheets

(51) Int. Cl.

| | |
|---|---|
| ***E21B 43/12*** | (2006.01) |
| ***E21B 47/024*** | (2006.01) |
| ***E21B 47/09*** | (2012.01) |

(56) References Cited

U.S. PATENT DOCUMENTS

| | | | | |
|---|---|---|---|---|
| 11,454,076 | B2 | 9/2022 | Ludwig et al. | |
| 11,499,372 | B2 | 11/2022 | Qi et al. | |
| 2014/0374089 | A1* | 12/2014 | Coles | G05D 7/0617 700/282 |
| 2015/0167414 | A1* | 6/2015 | Coles | E21B 47/12 166/250.01 |
| 2016/0229672 | A1 | 8/2016 | Breard et al. | |
| 2017/0241221 | A1 | 8/2017 | Seshdri et al. | |
| 2019/0203575 | A1 | 7/2019 | Schlosser | |
| 2020/0224508 | A1 | 7/2020 | Chapman et al. | |
| 2020/0270979 | A1* | 8/2020 | Hradecky | G05B 15/02 |
| 2021/0164309 | A1 | 6/2021 | Ludwig et al. | |
| 2021/0262303 | A1 | 8/2021 | Venna et al. | |
| 2023/0038625 | A1 | 2/2023 | Wu et al. | |
| 2023/0058152 | A1 | 2/2023 | Qi et al. | |
| 2023/0092758 | A1 | 3/2023 | Dyess et al. | |

OTHER PUBLICATIONS

Halliburton Auto Pumpdown Service, Consistent, efficient plug-and-perf operations every well, every crew, every time, H014451, Apr. 2023.

* cited by examiner

AUTONOMOUS STOP OF PUMP-DOWN OPERATION

CROSS REFERENCE TO RELATED APPLICATIONS

This application claims the priority of U.S. Provisional Patent Application No. 63/436,048, filed Dec. 29, 2022, which is incorporated by reference in its entirety.

BACKGROUND

Wells are drilled onshore and offshore to recover natural deposits of oil, gas, and other natural resources that are trapped in subterranean formations in the Earth's crust. Testing and evaluation of completed and partially finished wells are used to collect information to increase well production and return on investment. Downhole measurements of formation pressure, formation permeability, and recovery of formation fluid samples, may be useful for predicting economic value, production capacity, and production lifetime of geological formations. Further, perforating, fracturing, and other intervention operations in completed wells may also be performed to optimize well productivity.

Downhole tools, such as plugging and perforating tools, may be utilized to set a plug within a well to isolate a subterranean formation surrounding the wellbore from another subterranean formation and then perforate a casing and the isolated subterranean formation to prepare the well for production. The plugging and perforating tools may be included as part of the tool string and deployed downhole along with other downhole tools. The downhole tool string may be conveyed along the wellbore by applying controlled tension to the tool string from a wellsite surface via a conveyance line or other conveyance means.

In some downhole applications, such as in horizontal or otherwise deviated wellbores or when multiple bends are present along the wellbore, water or another fluid may be pumped into the wellbore above (or behind) the downhole tool string to push or "pump-down" the downhole tool string to an intended depth along the wellbore. During pump-down operations, downhole tool strings are deployed from the surface to a desired depth in a lateral wellbore via fluid pumped by one or more pump units at surface. The downhole tool strings are connected to a wireline, which is driven by a winch unit at surface. Generally, wellbores have one vertical section that provides access from surface to certain depth and one or more horizontal sections (e.g., lateral wellbores) deviated from the vertical section. In the lateral wellbores, gravity may not provide a driving force to move the downhole tool strings. Therefore, the pump-down operations are used to drive the downhole tool strings. Specifically, the pump-down operations coordinate the winch and pump units to drive the downhole tool strings in horizontal sections.

Downhole conveyance of the tool string is managed by a wellsite operator who monitors and controls depth, speed through a speed sensor device, wireline/cable tension through a cable tension device and/or other downhole parameters of the tool string. Pumping operations are managed by another wellsite operator who monitors and controls flow and pressure of the pumped fluid based on the depth, speed, and/or other downhole parameters of the tool string being conveyed. The wellsite operators visually monitor their equipment via corresponding control panels at the wellsite surface to identify detrimental or otherwise undesirable operational parameters or events, as well as to manually implement processes to counteract such parameters or events via the corresponding control panels. An example of an undesirable event may include a "pump-off" event, during which excessive fluid pressure above the tool string causes excessive tension of the conveyance line, thereby causing a cable head of the tool string to disconnect the conveyance line from the downhole tool string. Another undesirable event may also include a "stick-slip" event, during which the tool string systematically sticks to and slips along a sidewall of the wellbore, slowing down the rate at which the tool string progresses along the wellbore, among other potentially adverse effects.

For a successful pump-down operation, the operators need to maintain the wireline tension when the tool string reaches the landing point in deviated or horizontal wells. The operator of the pump unit and the operator of the winch unit need to coordinate closely to control pump unit and winch unit accordingly. Indeed, wireline tension may change significantly as the downhole tool string transitions from a vertical section of the wellbore to the lateral section. In the vertical section, the wireline may support the weight of the tool string, which puts the wireline in tension. However, in the lateral section, the wellbore may support a significant portion of the weight of the tool string, which may require adjusting the pump unit and/or wireline to maintain a desired tension in the wireline such that the tool string may advance smoothly in the horizontal section. Unfortunately, human error may result in the pump unit and/or winch unit being over or under adjusted, which may adversely affect completion operations.

BRIEF DESCRIPTION OF THE DRAWINGS

These drawings illustrate certain aspects of some of the embodiments of the present disclosure and should not be used to limit or define the method.

DETAILED DESCRIPTION

Figure 1:
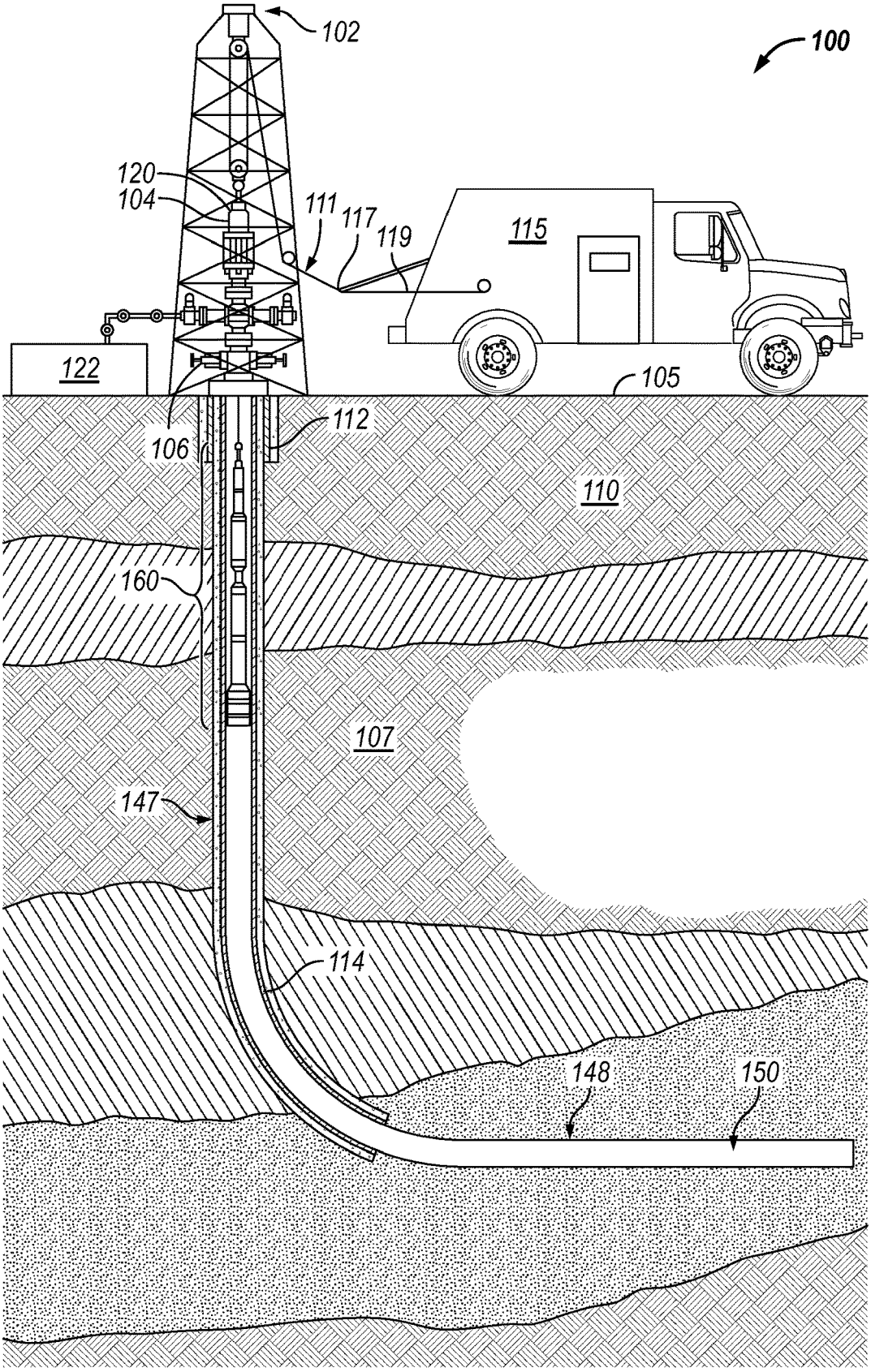
FIG. 1 illustrates a side schematic of a downhole operation in accordance with some embodiments of the present disclosure.

Disclosed herein are systems and methods for automating a pump-down stop operation and, more particularly, example embodiments may include an automated pump-down stop system that adjusts a fluid rate and a winch speed before the target depth based on the remaining depth and line speed. Automating the pump-down operation at the transition (e.g., at the rapid trajectory changes in the wellbore) may accurately and reliably maintain wireline tension in a desired range while avoiding slowing or stopping the winch unit, which may reduce operation costs, as well as reduce risk of human error during operation.

As previously noted, downhole conveyance of the tool string is managed by a wellsite operator who monitors and controls depth, speed through a speed sensor device, wireline or cable tension through a wireline sensing device, and/or other downhole parameters of the tool string. Pumping operations are managed by another wellsite operator who monitors and controls flow and pressure of the pumped fluid based on the depth, speed, and/or other downhole parameters of the tool string being conveyed. The wellsite operators visually monitor their equipment via corresponding control panels at the wellsite surface to identify detrimental or otherwise undesirable operational parameters or events, as well as to manually implement processes to counteract such parameters or events via the corresponding control panels in a coordinated and controlled fashion. However, relying on multiple wellsite operators to visually monitor and manually control the wellsite equipment in a coordinated and controlled fashion results in an inefficient conveyance of the downhole tool string, because undesirable operational parameters and events are very difficult to prevent and control via manual control of the wellsite equipment in coordination. For a successful stop operation, the operators need to stop the tool string at a desired target depth while maintaining the wireline tension. For that, the operator of the pump unit and the operator of the winch unit need to coordinate closely to stop the pump unit and the winch unit accordingly. If the pump unit is stopped too early, the tool string may not have enough drive force to reach the desired depth and the wireline will slack. If the pump unit is stopped too late, the wireline tension can increase beyond the limit when the winch is stopped. The excessive tension can damage the wireline or the tool string. Unfortunately, human error may result in the pump unit being stopped too early or too late, which may adversely affect completion operations.

The adjustment of the fluid rate and winch speed also includes estimation of the time delay from the time of command issuance to time when the tool string stops. The estimation ensures the wireline tension is maintained within the safety range which avoids any damage of the equipment or stopping at incorrect depth. Therefore, as set forth in greater detail below, the automated pump-down stop system permits one on-site operator or off-site operator to supervise the operation rather than two or more on-site operators to control the pump unit and the winch unit, respectively, which reduces operation costs and human error. For instance, a fluid rate delay time from surface to the downhole tool string may be calculated by dividing the speed of fluid traveling in the wellbore by the measured depth of the downhole tool string, wherein the downhole tool string is in contact with the wellbore fluid. The speed of fluid traveling in the wellbore may be measured by any sensor capable of measuring the speed of a fluid including any sensor capable of measuring the speed of the fluid in contact with the sensor located on the downhole tool string or any sensor capable of measuring the speed of the fluid in contact with the sensor located at surface corrected by a fluid rate delay time. The sensor may be any flow meter or pressure sensor installed on the downhole tool string or at surface or at both locations. The calculation for the delay time may rely on the signature of the sensor location at surface and the same signature located on the downhole tool string. The signature includes the frequency of the signal, the amplitude of the signal, or any combination thereof. Having a sensor capable of measuring in real time the speed of fluid on the downhole tool string and another sensor capable of measuring in real time the speed of fluid at surface allows to estimate the delay time between the change of speed of the fluid at surface when the pump rate is varied and the change of the speed of fluid on the downhole tool string. The delay time may be calculated based on a pressure sensor at surface and another pressure sensor on the downhole tool string, for example. The delay time between the change of pump rate at surface and the change of the speed of the fluid around the downhole tool string may be calculated based on a flow meter located at surface and another flow meter located on the downhole tool string, for example. The delay time may be calculated based on any combination of sensors located at surface and at least another sensor located on downhole tool string, wherein the at least two sensors may be the same type of sensors or different type of sensors.

Automating the pump-down operation may include calculating the winch stop depth by subtracting the product of total delay time of a winch unit and a current line speed to the target depth, wherein the total delay time comprises at least the response delay time of the winch unit. Automating the pump-down operation may include calculating pump stop depth by subtracting the product of total delay time of a pump unit and a current line speed to the target depth. The total delay time of the pump unit and the current line speed comprises response delay time of the pump unit, response delay time of a winch unit, response delay time of a fluid rate from surface to downhole, and any combination thereof. Automating the pump-down operation may include regulating automatically a winch controller and a pump controller simultaneously to stop the downhole tool string at a target depth which comprises calculating a pump stop depth and a winch stop depth separately and/or by including different received inputs. Automating the pump-down operation may include regulating automatically a winch controller and a pump controller simultaneously to stop the downhole tool string at a target depth while maintaining the wireline tension within a safety range. Alternatively, automating the pump-down operation may include regulating automatically a winch controller and a pump controller and stopping the pump unit before or after the winch unit. Automating the pump-down operation may include regulating automatically a pump controller to a minimum fluid rate output at the calculated pump stop depth in the case of a toc-up wellbore condition. The minimum fluid rate can be given by the user input, or through modeling or static calculation.

FIG. 1 illustrates a schematic of a downhole operation 100, in accordance with some embodiments of the present disclosure. In general, surface equipment provides power, material, and structural support for the operation of the pump down downhole tool string 160. The surface equipment may include a drilling rig 102 and associated equipment, such as a data logging and control truck 115. Control truck 115 may comprise a winch controller (not shown), a winch control unit (not shown), and a control panel (not shown). Rig 102 may include equipment such as a rig pump 122 disposed proximal to the rig 102. The rig 102 can include equipment used when a well is being logged or later perforated such as a tool lubrication assembly 104 and a pack off pump 120. In some implementations, a blowout preventer 103 will be attached to a casing head 106 that is attached to an upper end of a well casing 112. Rig pump 122 provides pressurized drilling fluid to the rig and some of its associated equipment. Control truck 115 monitors the data logging operation and receives and stores logging data from the logging tools and/or controls and directs perforation operations. Below rig 102 is the wellbore 150 extending from the surface 105 into the earth 110 and passing through a plurality of subterranean geologic formations 107. Wellbore 150 penetrates through the formations 107 and in some implementations forms a deviated path, which may include a substantially horizontal section. Wellbore 150 may be reinforced with one or more casing strings 112 and 114.

The downhole tool string 160 may be attached with a cable/wireline 111, the wireline tension measured by a wireline tension sensing device 117, and/or by a wireline tension sensing device located on downhole tool string 160, and the wireline speed measured by a speed sensor device 119. The conveying process is conducted by pumping a fluid from rig pump 122 (e.g., pump unit) into the upper proximal end of the casing string 112 (or 114) above the downhole tool string 160 to assist, via fluid pressure on the downhole tool string 160, movement of the downhole tool string 160 down the wellbore 150 and along inclined and horizontal sections of the wellbore 150. The pump pressure of the fluid above the downhole tool string 160 is monitored by a pressure sensing device (not shown) and the data sent to a control panel, control truck 115 for example, wherein pump unit 122 may be controlled through pump controller (not shown) as the fluid pressure changes during the conveying process and exhibit patterns indicating events such as sticking of the downhole tool string 160 in the wellbore 150. As the downhole tool string 160 is pumped (propelled) downwards by the fluid pressure that is pushing behind the downhole tool string 160, the wireline 111 is spooled out at the surface by control truck 115 (e.g., winch unit) by the wellsite operator. A wireline tension sensing device (not shown) may be on downhole tool string 160 to measure wireline tension downhole or downhole tension measured. Another wireline tension sensing device 117 may be located at surface. Either one of the wireline tension sensing devices (located on downhole tool string 160 or at surface with 117) or the combination of the two wireline sensing devices provides wireline tension data to control it from control truck 115 through winch controller (not shown). A speed sensor device 119 located at surface provides surface wireline speed data to control it from truck 115 by the wellsite operator. A speed sensor device (not shown) located on downhole tool string 160 may provide the wireline speed data to control the wireline speed from truck 115 by the wellsite operator as well.

Figure 2:
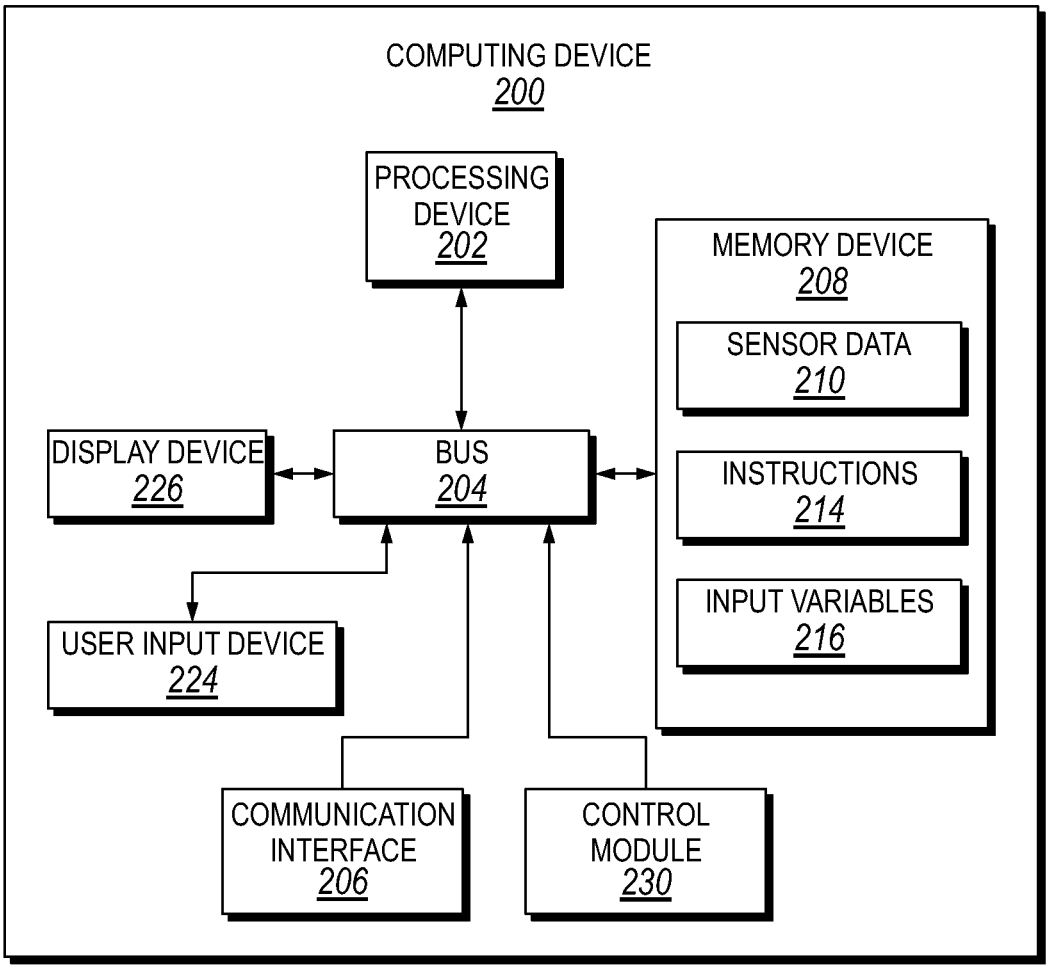
FIG. 2 illustrates a block diagram of a computing device of an automated pump-down stop system in accordance with some embodiments of the present disclosure.

In contrast, sensors and/or instrumentation related to operation of the system may be connected to a computing device according to some embodiments of the present disclosure (e.g., computing device 200 on FIG. 2). In various implementations, computing device 200 may be deployed in a work vehicle, such as control truck 115. Computing device 200 may be permanently installed with the system, may be hand-held, or may be remotely located. In some embodiments, computing device 200 may be distributed across two or more computers. In some examples, computing device 200 may process at least a portion of the data received and may transmit the processed or unprocessed data to a remote computing device via a wired or wireless network. Computing device 200 may be on-site, or may be off-site, such as at a data-processing center. Computing device 200 may receive the data, execute computer program instructions to analyze the data, and communicate the analysis results to computing device 200. For example, computing device 200 may communicate with a winch controller configured to control the winch unit (e.g., deployed in control truck 115) for feeding the wireline/cable 111. Further, computing device 200 may communicate with a pump controller configured to control the hydraulic pump (e.g., pump unit 122).

FIG. 2 illustrates a block diagram of computing device 200 of an automated pump-down stop system, in accordance with some embodiments of the present disclosure. For example, computing device 200 may include a processing device 202, a bus 204, a communication interface 206, a memory device 208, a user input device 224, a display device 226, and a control module 230. In some examples, some or all of the components shown in FIG. 2 may be integrated into a single structure, such as a single housing. In other examples, some or all of the components shown in FIG. 2 may be distributed (e.g., in separate housings or locations) and in communication with each other.

The processing device 202 can execute instructions 214 stored in memory device 208 to perform the pump down operations. For example, processing device 202 can include one processing device or multiple processing devices. Non limiting examples of processing device 202 include a Field-Programmable Gate Array ("FPGA"), an application specific integrated circuit ("ASIC"), a micro processing device, etc.

The processing device 202 may be communicatively coupled to the memory device 208 via bus 204. The non-volatile memory device 208 may include any type of memory device that retains stored information when powered off. Non-limiting examples of memory device 208 include electrically erasable and programmable read only memory ("EEPROM"), flash memory, or any other type of non-volatile memory. In some examples, at least some of memory device 208 may include a non-transitory medium from which the processing device 202 can read instructions. A computer-readable medium can include electronic, optical, magnetic, or other storage devices capable of providing processing device 202 with computer-readable instructions or other program code. Limiting examples of a computer-readable medium include (but are not limited to) magnetic disk (s), memory chip (s), read-only memory (ROM), random-access memory ("RAM"), an ASIC, a configured processing device, optical storage, or any other medium from which a computer processing device can read instructions. The instructions can include processing device specific instructions generated by a compiler or an interpreter from code written in any suitable computer-programming language, including, for example, C, C++, C#, etc.

In some examples, memory device 208 can include sensor data 210, (e.g., wireline tension sensing device 117 (referring to FIG. 1) data, wireline tension sensing device located on downhole tool string 160, speed sensor device 119 data, strain gauge data, etc.), for example. The memory device 208 can also include a database of input variables 216, such as, mud weight, inclination of the wellbore, bending moment, as well as constraints such as kinematics constraints, and safety constraints. In some examples, memory device 208 can include a computer program code instructions 214 for control of various aspects of the pump down operations. Other collected data related to the pump down operations may be stored in a log.

In some examples, computing device 200 can include a communication interface 206. Communication interface 206 can represent one or more components that facilitate a network connection or otherwise facilitate communication between electronic devices. Examples include, but are not limited to, wired interfaces such as Ethernet, USB, IEEE 1394, and/or wireless interfaces such as IEEE 802.11, Bluetooth, near-field communication (NFC) interfaces, RFID interfaces, or radio interfaces for accessing cellular telephone networks (e.g., transceiver/antenna for accessing a CDMA, GSM, UMTS, or another mobile communications network). In some examples, the computing device 200 can include a user input device 224. The user input device 224 can represent one or more components used to input data. Examples of the user input device 224 can include a keyboard, mouse, touchpad, button, or touch screen display, etc. In some examples, the computing device 200 includes a display device 226. The display device 226 can represent one or more components used to output data. Examples of display device 226 can include a liquid crystal display (LCD), a computer monitor, a touch-screen display, etc. In some examples, the user input device 224 and the display device 226 can be a single device, such as a touch-screen display.

The automated pump-down stop system may include control module 230 to implement a control algorithm for automated pump down stop operation according to some aspects of the present disclosure as described in more detail below.

Figure 3:
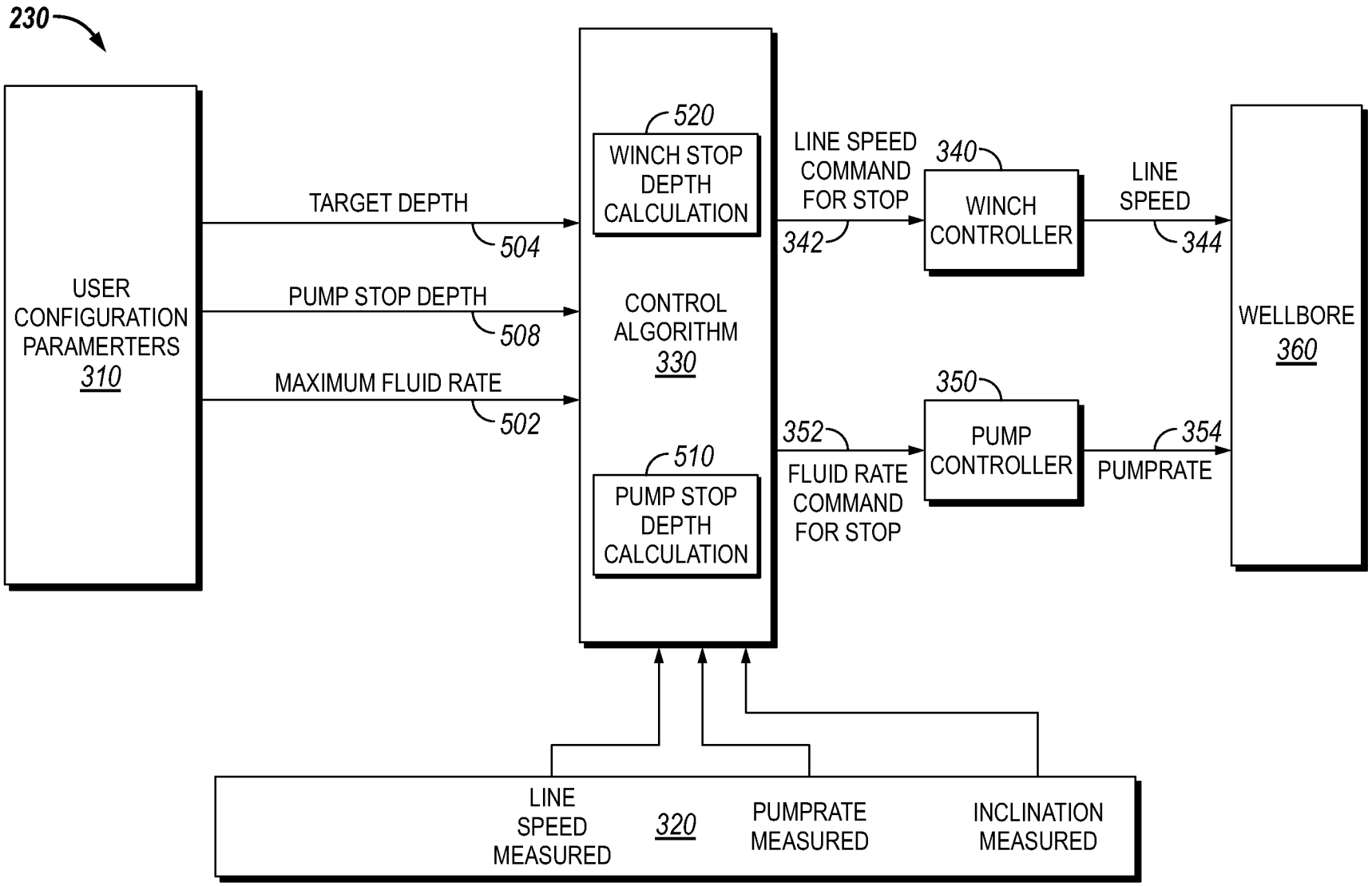
FIG. 3 is a block diagram illustrating an example of a control module for implementing a control algorithm for automated pump-down operation according to some aspects of the present disclosure.

FIG. 3 is a block diagram illustrating an example of control module 230 for implementing a control algorithm for automated pump-down stop operation according to some aspects of the present disclosure. The control module 230 may take user configuration parameters 310 and measurement parameters 320 as inputs to the control algorithm 330, make the calculations for estimated pump stop depth 510 and estimated winch stop depth 520, and may output a wireline line speed command for stop 342 for winch controller 340 and a fluid rate command for stop 352 for pump controller 350. The user configuration parameters 310 may include a target depth 504, a pump stop depth 508, a minimum fluid rate 502, and any combination thereof. The measurement parameters 320 may include measured downhole tool string 160 depth, measured wireline line speed, measured speed of fluid traveling in the wellbore, measured wellbore inclination, and any combination thereof. The speed of fluid traveling in the wellbore may be measured by any sensor capable of measuring the speed of a fluid including any sensor capable of measuring the speed of the fluid in contact with the sensor located on the downhole tool string or any sensor capable of measuring the speed of the fluid in contact with the sensor located at surface corrected by a fluid rate delay time.

The configuration parameters 310 and measurement parameters 320 may be input to the control algorithm 330. The control algorithm 330 may calculate an estimated winch stop depth 520 and an estimated pump stop depth 510 depending upon the target stop depth 504 of the downhole tool, and output a line speed command for stop 342 to winch controller 340, and a fluid pump rate command for stop 352 to pump controller 350. The winch controller 340 and the pump controller 350 may generate wireline speed command 344 and pump rate command 354, respectively, to control the downhole tension 362 of the wireline/cable 111 in wellbore 150 (referring to FIG. 1). The estimated winch stop depth 520 may be a single value or a range of values. The estimated pump stop depth 510 may be a single or a range of values. The estimated pump stop depth 510 may be different than the estimated winch stop depth 520 or may be the same value or range of values. However, their calculations may be performed independently from one another.

The automated pump-down stop system is configured to receive inputs 310 and 320 (e.g., target depth, actual depth, and system parameters), calculate pump stop depth 510 and winch stop depth 510 estimations, and output respective commands to the pump unit 122 and winch unit (e.g., deployed in control truck 115) such that the downhole tool string 160 stops at the target depth. That is, the automated pump-down stop system may be configured to generate, based on received inputs 310 and 320, pump fluid rate command 354 and winch line speed command 344 to control pump unit 122 and winch unit (e.g., deployed in control truck 115), respectively, to stop or slow down such that the wireline speed reaches zero when the downhole tool string 160 reaches the target depth. When the line speed reaches zero, the fluid rate downhole is in a safety range to avoid wireline 111 or downhole tool string 160 damage. The received inputs 310 and 320 may include the target depth 504, an actual depth, and various system parameters (e.g., response delay time of the pump unit 122, response delay time of the winch unit (e.g., deployed in control truck 115), speed of sound in wellbore 150 fluid, delay time of the fluid rate from surface to downhole, wellbore inclination or data base of previous operations, etc.). The target depth 504 is a depth corresponding to a desired position for the downhole tool string 160 in the wellbore 150. Moreover, the actual depth is a real-time depth of the downhole tool string 160. The actual depth may be determined based at least in part on a measurement of unspooled wireline 111 length and/or a measurement of the downhole tool string 160.

Moreover, as set forth below, the automated pump-down stop system may be configured to determine the estimated pump stop depth 510 and the estimated winch stop depth 520. The winch unit (e.g., deployed in control truck 115) is expected to reach zero speed when the downhole tool string 160 reaches the target depth 504. To avoid excessive wireline 111 tension when the winch unit stops, the fluid rate at the downhole tool string 160 is expected to be zero or less than the minimum rate for moving the downhole tool string 160. However, pump unit 122 and winch unit (e.g., deployed in control truck 115) may not be stopped at the same time because of the fluid rate delay time from surface to downhole and other system delays. The fluid rate delay time from surface to downhole can be estimated as the actual depth of the downhole tool string 160 divided by the speed of sound in wellbore 150 fluid. Further, the pump stop depth can be calculated as target depth 504 minus the product of total delay time of the pump unit 122 and the current line speed 344. The equation can be given as:

$$\text{Depth}_{pump\ stop} = \text{Depth}_{target} - \left(T_{pump} + \frac{\text{Depth}_{actual}}{V_{sound\ in\ fluid}}\right) \times LSPD \quad \text{Equation (1)}$$

In Equation 1 above, $\text{Depth}_{pump\ stop}$ is the depth for stopping the pump, $\text{Depth}_{target}$ is the target depth for stopping the downhole tool string, $T_{pump}$ is the system delay time from fluid rate command for stop to the actual fluid rate stopping at depth of the downhole tool string, $\text{Depth}_{actual}$ is the actual depth of the downhole tool string, $V_{sound\ in\ fluid}$ is the speed of sound in wellbore fluid, LSPD is the fixed line speed after the tool strings reach pump stop depth.

In response to reaching the pump stop depth, the system may output a pump fluid rate command for stop 352 through pump controller 350 to pump unit 122 (i.e., instructing pump unit 122 to reduce the fluid rate to zero). Meanwhile, the line speed command for stop 342 may be fixed to the current line speed. The downhole tool string 160 may temporarily continue to move after stopping pump unit 122 via the fluid already pumped into wellbore 150 that may have a high fluid rate. However, as downhole tool string 160 reaches the target depth 504, the fluid rate at downhole tool string 160 may be close to zero such that it will be safe to bring line speed 344 down to zero. Accordingly, the winch stop depth may be at the target depth.

In some examples, the winch system (winch controller 340 outputting line speed command 344 to the winch unit deployed in control truck 115) may have delays between outputting the line speed command for stop 342 and the actual line speed changing proximate the target depth for downhole tool string 160. This delay may be considered in determining timing for outputting the line speed command for stop 342. Generally, the line speed command for stop 342 may be outputted before the target depth 504 is reached. Further, in some examples, the pump stop depth and winch stop depth may be estimated separately and/or by including different system parameters 310 and 320, such as wellbore pressure. Additionally, in some examples, the pump stop depth and winch stop depth may be estimated via statistics or algorithms from previous pump-down operations.

Figure 4:
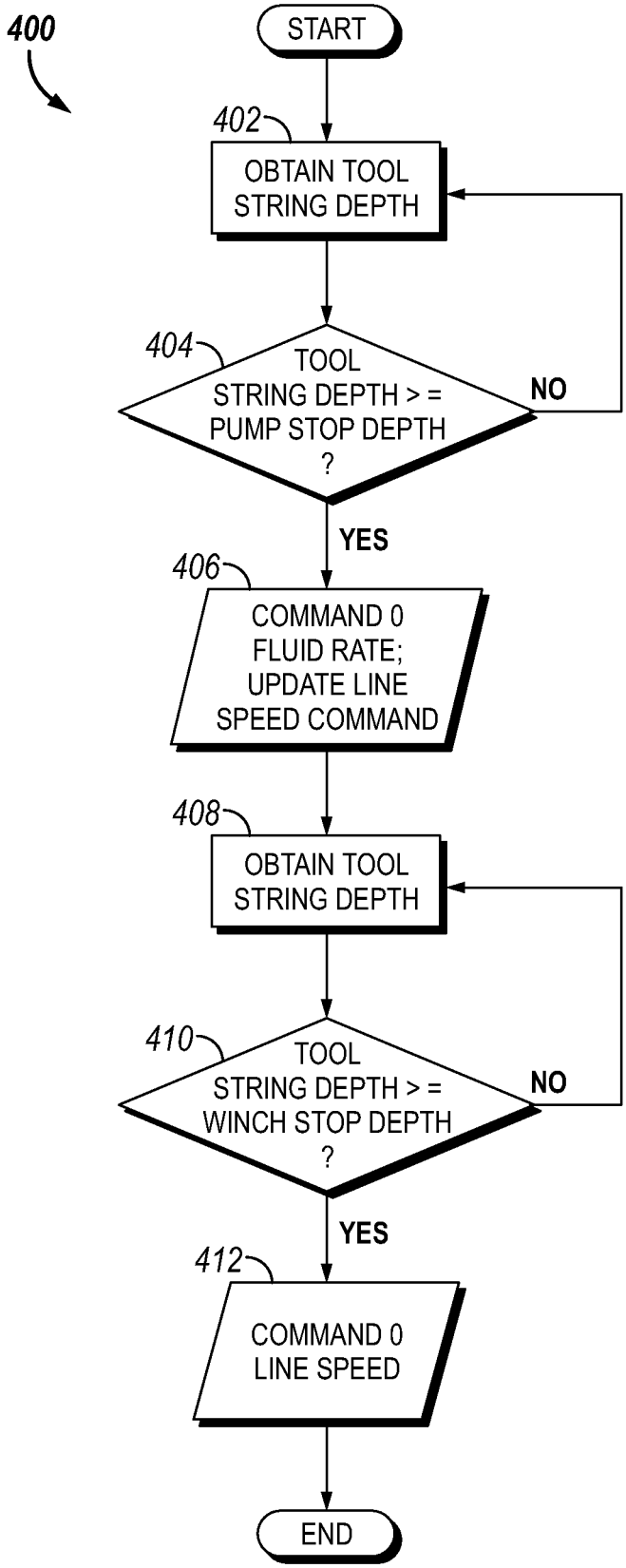
FIG. 4 illustrates a flow diagram of a method for automating a pump-down stop operation in accordance with some embodiments of the present disclosure.

FIG. 4 illustrates a flow diagram of a method for automating a pump-down stop operation 400, in accordance with some embodiments of the present disclosure. The automated pump-down stop system may be configured to calculate or estimate the pump stop depth 510 for stopping the pump unit 122 and the winch stop depth 520 for stopping the winch unit (e.g., deployed in control truck 115) separately. The calculation may be performed independently from one another or in coordination with one another. Therefore, the resulting line speed command for stop 342 and fluid rate command for stop 352 may also be sent independently from one another or in coordination with one another. Moreover, as illustrated, method 400 may measure an actual depth of the tool string 402 and compare against a pump stop depth 404 (e.g., a depth estimation for stopping the pump unit 510 such that the downhole tools string 160 stop at the target depth 504). If the downhole tool string depth is less than the pump stop depth, then the automated pump-down stop system may be configured to take another measurement to determine the actual depth 402 of the downhole tool string 160 in real-time and compare against the pump stop depth. This process may continue to repeat until the downhole tool string 160 depth is greater than or equal to the calculated pump stop depth 510.

In response to the actual depth of the downhole tool string 160 being greater than or equal to a pump stop depth, the automated pump-down stop system may generate a fluid rate command for stop 406 (352 in FIG. 3). Generally, the fluid rate command for stop 406 is configured to reduce a fluid pump rate 354 through pump unit 122 to about zero, which stops the pump unit 122 at surface. Further, after the downhole tool string 160 reaches the pump stop depth, the winch speed may be fixed to the current speed or regulated based on the wireline 111 tension.

Moreover, as illustrated, in response to pump unit 122 reducing the fluid pump rate 406, the automated pump-down stop system may be configured to take further measurements 408 to determine the actual depth of the downhole tool string 160 in real-time and compare the actual depth of the downhole tool string 160 against a winch stop depth 410 (e.g., 520 in FIG. 3 or a depth estimation for stopping the winch unit (e.g., deployed in control truck 115) such that the downhole tool string 160 stops at the target depth 504). If the downhole tool string 160 depth is less than the winch stop depth, then the automated pump-down stop system may be configured to continue to take measurements to determine the actual depth of the tool string in real-time 408 and compare against the winch stop depth 410. This process may be repeated until the downhole tool string 160 depth is greater than or equal to the winch stop depth. However, in response to the actual depth of the downhole tool string 160 being greater than or equal to a winch stop depth, the automated pump-down stop system may generate a line speed command 344 for stopping the winch unit at surface 412. As set forth above, the line speed command 344 may instruct the winch unit (e.g., deployed in control truck 115) to reduce the line speed to zero as the downhole tool string 160 reaches the target depth.

Figure 5:
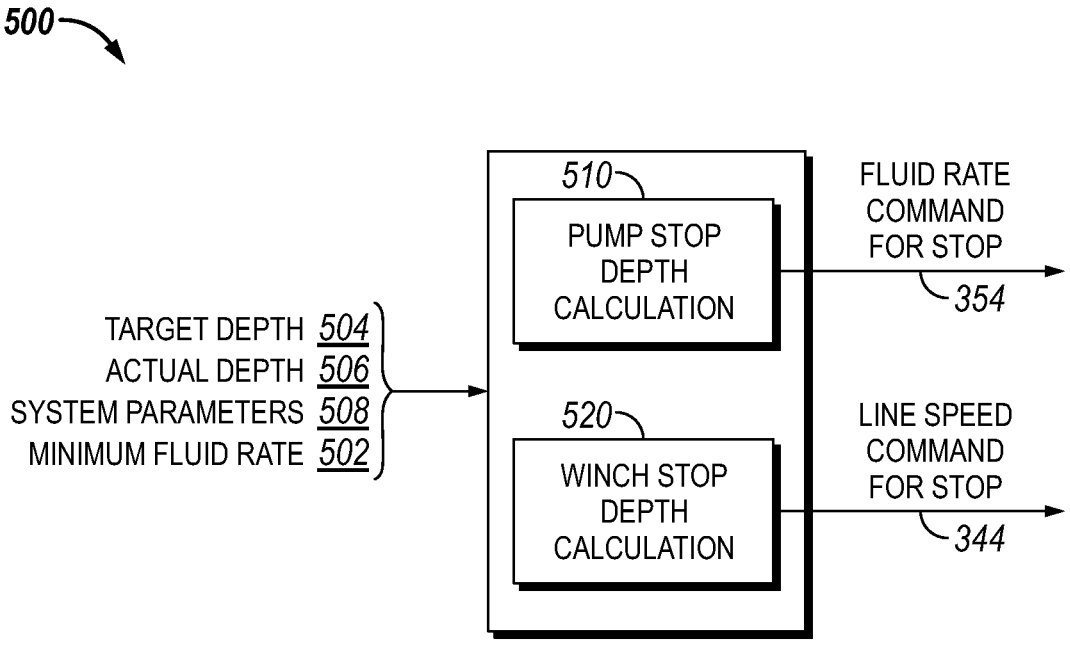
FIG. 5 illustrates a flow diagram of another automated pump-down stop system in accordance with some embodiments of the present disclosure.

FIG. 5 illustrates a flow diagram of an automated pump-down stop system 500 in the wellbore with toc-up condition, in accordance with some embodiments of the present disclosure. The toe-up condition means the wellbore deviates more than 90°. If the downhole tool string 160 (referring to FIG. 1) is planned to stop at the toc-up condition, the tool string weight, via gravity, can drive the tool string backward (e.g., uphole, toward the surface). Therefore, the pump unit 122 may output a minimum fluid rate 502 required to maintain the position of the downhole tool string 160 for the wellbore fluid to add weight to the downhole tool string 160 during pump-down stop operations depending upon target depth 504, actual depth 506, and system parameters 508. As such, the automated pump-down stop system 500 may receive an additional input corresponding to the minimum fluid rate 502 needed for wellbore with a toe-up condition to prevent backwards movement of downhole tool string 160. The minimum fluid rate 502 may be determined via a user defined value, physical modeling, or statistics from previous operations to calculate the pump stop depth 510 and the winch stop depth 520 and output a fluid rate command for stop 352 and a line speed command for stop 342, respectively.

Figure 6:
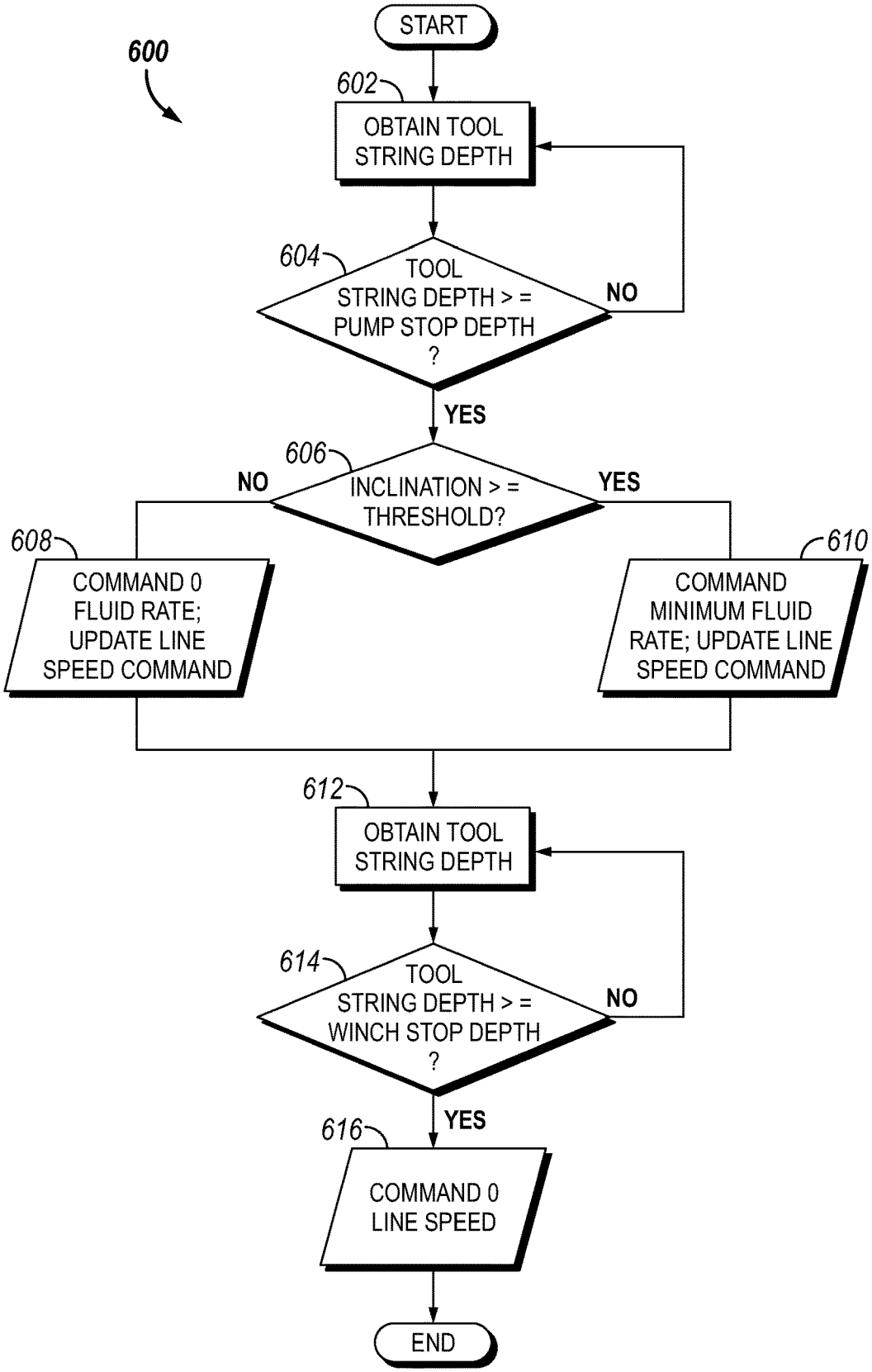
FIG. 6 illustrates a flow diagram of another method for automating a pump-down stop operation in accordance with some embodiments of the present disclosure.

FIG. 6 illustrates a flow diagram of another method for automating a pump-down stop operation system 600, in accordance with some embodiments of the present disclosure. As set forth above, the automated pump-down stop system 600 may be configured to calculate or estimate the depth for stopping the pump unit 122 (e.g., 510 referring to FIG. 5) and winch unit (e.g., 520 referring to FIG. 5) separately. Moreover, as illustrated, the method may measure an actual depth at step 602 of the downhole tool string 160 and compare it against the calculated pump stop depth 510 at step 604 (e.g., a depth estimation for stopping pump unit 112 such that the downhole tools string 160 stops at the target depth 504). If the downhole tool string 160 depth is less than the calculated pump stop depth (or 510 in FIG. 5), then the automated pump-down stop system 600 may be configured to take another measurement to determine the actual depth 604 of the downhole tool string 160 in real-time and compare it against the calculated pump stop depth 510 at step 604. This process may be repeated until the downhole tool string 160 depth is greater than or equal to the calculated pump stop depth 510.

In response to the actual depth of the downhole tool string 160 being greater than or equal to the calculated pump stop depth 510, the automated pump-down stop system 600 may generate a fluid rate command for stop 352 (e.g., a fluid rate stop command or minimum fluid rate command) based at least in part on an inclination of the lateral wellbore at step 606. If the inclination of the toe up condition is less than a threshold value, the automated pump-down stop system 600 is configured to output the fluid rate command for stop 352

(e.g., zero fluid rate command) at step 608. However, if the inclination of the lateral wellbore is greater than the threshold value (e.g., lateral wellbore with a toe up condition), the automated pump-down stop system 600 is configured to output the minimum fluid rate command at step 610 to prevent backwards movement of the downhole tool string 160.

Moreover, as illustrated, in response to pump unit 122 reducing the fluid flow rate, at step 608 or 610, the automated pump-down stop system 600 may be configured to take further measurements to determine the actual depth at step 612 of the downhole tool string 160 in real-time and compare the actual depth of downhole tool string 160 against a calculated winch stop depth 520 at step 614 (e.g., a depth estimation for stopping the winch unit such that the downhole tools strings stop at target depth 504). If the downhole tool string 160 depth is less than the calculated winch stop depth 520, then the automated pump-down stop system 600 may be configured to continue to take measurements to determine the actual depth of downhole tool string 160 in real-time at step 612 and compare it against the calculated pump stop depth 510. This process may be repeated until the downhole tool string 160 depth is greater than or equal to the calculated winch stop depth 520. However, in response to the actual depth of the downhole tool string 160 being greater than or equal to the calculated winch stop depth 520, the automated pump-down stop system 600 may generate a line speed command for stop 342 for stopping the winch unit (e.g., deployed in control truck 115) at surface at step 616. As set forth above, the line speed commands for stop 342 may instruct the winch unit to reduce the line speed to zero as the downhole tool string 160 reaches the target depth.

In some embodiments, the automated pump-down stop system 600 may determine the pump stop and winch stop timing via a predefined desired depth of stopping the pump 508 and stopping the winch. The user may provide a first desired depth reference for pump stop 508 and a second desired depth reference for winch stop, which may be obtained from user's experience, offline calculation, or any other suitable source. Alternatively, the automated pump-down stop system 600 may determine the pump stop and winch stop timing via a predefined desired time for stopping pump and stopping winch. The user may provide a first desired time reference for pump and a second desired time reference for winch stop, which may be used to calculate a desired depth reference for stopping the pump and stopping the winch, based on the line speed. Accordingly, the present disclosure may provide systems and methods for automating a pump-down stop operation. Embodiments may include any suitable combination of the features disclosed herein, including but not limited to the following examples.

Statement 1. A method for automating a pump-down stop operation of a downhole tool string comprising: measuring a depth of the downhole tool string, wherein the downhole tool string is held by a wireline; measuring a wireline tension; measuring a speed of the wireline; measuring a pumping rate; measuring an inclination of the downhole tool string; and regulating automatically a winch controller and a pump controller simultaneously to stop the downhole tool string at a target depth based at least on the measurements of one or more of the depth, wireline tension, speed, pumping rate, and/or inclination.

Statement 2. The method of Statement 1, wherein the winch controller controls a winch unit comprising the wireline, and the pump controller controls the pumping rate of a pump unit.

Statement 3. The method of Statement 1 or Statement 2, wherein the pump unit is stopped before the winch unit.

Statement 4. The method of any of Statements 1-3, further measuring a speed of fluid traveling in the wellbore using one flow meter located at surface and another flow meter located on the downhole tool string; and calculating a delay time for a change of flow rate between a measured flow rate at surface and a measured flow rate on the downhole tool string with the same signature.

Statement 5. The method of any of Statements 1-4, further measuring a speed of fluid traveling in the wellbore using one pressure sensor located at surface and another pressure sensor located on the downhole tool string; and calculating a delay time for a change of pressure between a measured pressure at surface and a measured pressure on the downhole tool string with the same signature.

Statement 6. The method of any of Statements 1-5, wherein regulating automatically comprises calculating pump stop depth and winch stop depth based on received inputs.

Statement 7. The method of any of Statements 1-6, wherein regulating automatically comprises an input for a pump stop depth and an input for a winch stop depth.

Statement 8. The method of any of Statements 1-7, wherein regulating automatically comprises processing received inputs, wherein the received inputs comprise at least one received input selected from the group consisting of a target depth, an actual depth, a response delay time of a pump unit, a response delay time of a winch unit, a wellbore pressure, a delay time of a fluid rate from surface to downhole, a wellbore inclination, data base of previous operations, and any combination thereof.

Statement 9. The method of any of Statements 1-8, further measuring a depth of the downhole tool string and calculating a fluid rate delay time from surface to downhole by dividing a speed of sound in a wellbore fluid by the measured depth of the downhole tool string, wherein the downhole tool string is in contact with the wellbore fluid.

Statement 10. The method of any of Statements 1-9, wherein regulating automatically comprises calculating pump stop depth by subtracting the product of total delay time of a pump unit and a current line speed to the target depth, wherein the total delay time comprises at least one delay time selected from the group consisting of response delay time of the pump unit, response delay time of a winch unit, response delay time of a fluid rate from surface to downhole, and any combination thereof.

Statement 11. The method of any of Statements 1-10, wherein regulating automatically a winch controller and a pump controller simultaneously to stop the downhole tool string at a target depth comprises using an algorithm developed in at least one previous pump-down operation.

Statement 12. The method of any of Statements 1-11, further monitoring the method remotely.

Statement 13. The method of any of Statements 1-12, wherein the different received inputs comprise at least two different received inputs selected from the group consisting of a target depth, an actual depth, a response delay time of a pump unit, a response delay time of a winch unit, a speed of a fluid traveling in a wellbore, a speed of sound in a wellbore fluid, a wellbore pressure, a delay time of a fluid rate from surface to downhole, a wellbore inclination, data base of previous operations, and any combination thereof.

Statement 14. The method of any of Statements 1-13, wherein regulating automatically a winch controller and a pump controller in sequence to stop the downhole tool string at a target depth comprises calculating a pump stop depth and a winch stop depth separately and/or by including different received inputs.

Statement 15. The method of any of Statements 1-14, regulating automatically a winch controller and a pump controller simultaneously to stop the downhole tool string at a target depth comprises maintaining the wireline tension within a safety range.

Statement 16. A method for automating a pump-down stop operation, comprising: measuring an actual depth of a downhole tool string in a wellbore; determining a position of the downhole tool string based at least on the actual depth with respect to a pump stop depth in the wellbore; outputting a fluid rate stop command to a pump unit in response to determining that the actual depth of the downhole tool string is greater than or equal to the pump stop depth, wherein the fluid rate stop command comprises instructions for the pump unit to reduce a fluid flow rate into the wellbore; determining the position of the downhole tool string with respect to a winch stop depth in the wellbore; and outputting a line speed command to a winch unit in response to determining that the actual depth of the tool string is greater than or equal to the winch stop depth, wherein the line speed command comprises instructions for the winch unit to reduce a line speed of a wireline connected to the tool string.

Statement 17. The method of Statement 16, wherein the pump stop depth is calculated by subtracting the product of a fixed line speed after the tool string reaches pump stop depth times the actual depth of the tool string to a target depth for stopping the tool string.

Statement 18. The method of Statement 16, wherein the pump stop depth is calculated using the following equation:

$$\text{Depth}_{pump\ stop} = \text{Depth}_{target} - \left(T_{pump} + \frac{\text{Depth}_{actual}}{V_{sound\ in\ fluid}}\right) \times LSPD$$

wherein $\text{Depth}_{pump\ stop}$ is the depth for stopping the pump, $\text{Depth}_{target}$ is a target depth for stopping the tool string, $T_{pump}$ is a system delay time for commanding fluid rate target to fluid rate at surface reaches target, $\text{Depth}_{actual}$ is the actual depth of the downhole tool string, $V_{sound\ in\ fluid}$ is the speed of sound in wellbore fluid, LSPD is the fixed line speed after the tool string reaches pump stop depth.

Statement 19. A system for automating a pump-down stop operation, comprising: a data logging and control truck; a tool string attached to a wireline; at least one cable tension sensing device; a speed sensor device; and at least one computing device in communication with a pump controller and a winch controller, wherein the pump controller controls at least one pumping unit and the winch controller controls at least one winch unit, wherein the at least one computing device is configured to take user configuration parameters and measurement parameters as inputs to a control algorithm and output a line speed reference signal to the winch controller and a pump rate reference signal to the pump controller, wherein the at least one computing device comprises the control module.

Statement 20. The system of Statement 19, wherein the user configuration parameters comprise at least one user configuration parameter selected from the group consisting of a recommended job speed, a value for downhole tension target in inclined section of a wellbore, a value for minimum downhole tension target, a tool string weight, a maximum available pump rate, a winch speed safe limit, and any combinations thereof, and wherein the measurement parameters comprise at least one measurement parameter selected from the group consisting of a measured speed of a fluid traveling in a wellbore, a measured depth of the tool string, a measured downhole cable tension, a measured cable line speed, a measured pump rate, a measured tool string inclination, and any combination thereof.

To facilitate a better understanding of the present invention, the following examples of certain aspects of some embodiments are given. In no way should the following examples be read to limit, or define, the entire scope of the disclosure.

EXAMPLES

Different use case scenarios were simulated to evaluate the performance of some embodiments for automating a pump down stop operation.

Figure 7:
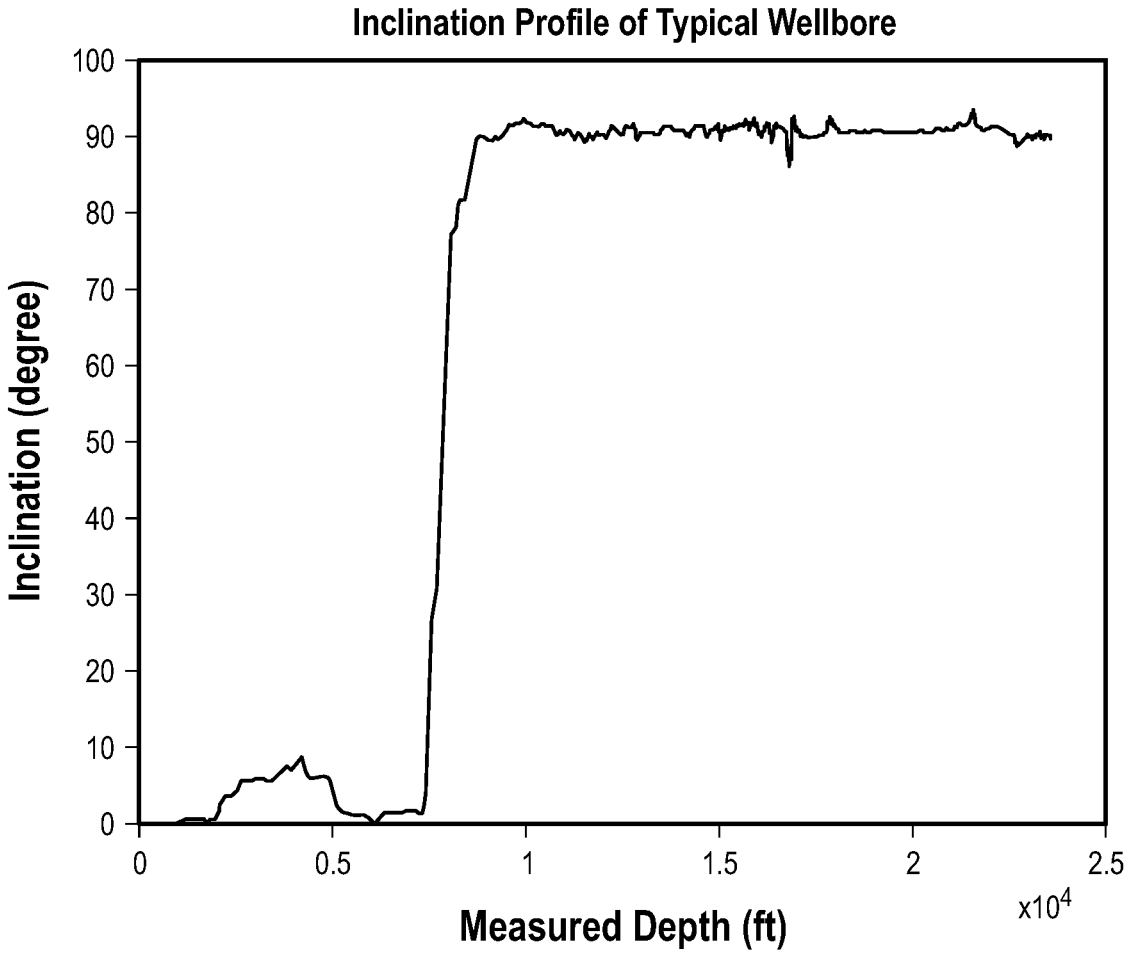
FIG. 7 shows a survey of a wellbore used for a set of simulations according to some embodiments of the present disclosure.

FIG. 7 shows a survey of a wellbore used for a set of simulations according to some embodiments of the present disclosure through the inclination of the wellbore plotted as a function of the measured depth in feet (ft). The inclination varies from 0 to around 8.75 degrees the first 5,000 ft before going from 1 to around 92 degrees from 6,000 ft to 10,000 ft to simulate a wellbore having a vertical section from surface to around 7,500 ft followed by a horizontal section from around 8,000 ft to 23,586 ft. The highly deviated section from 7,500 ft to 8,250 ft can be problematic for a pump down operation where coordination between the pump unit and the winch unit is paramount for a successful and efficient operation.

Figure 8A:
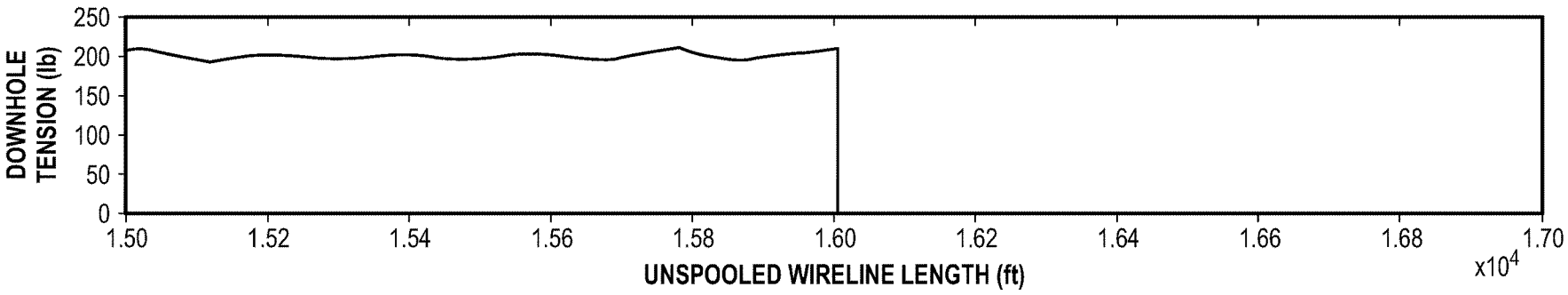
FIGS. 8*a* to 8*c* shows an example of an automated stop of a pump down operation according to embodiments of the present disclosure.
Figure 8B:
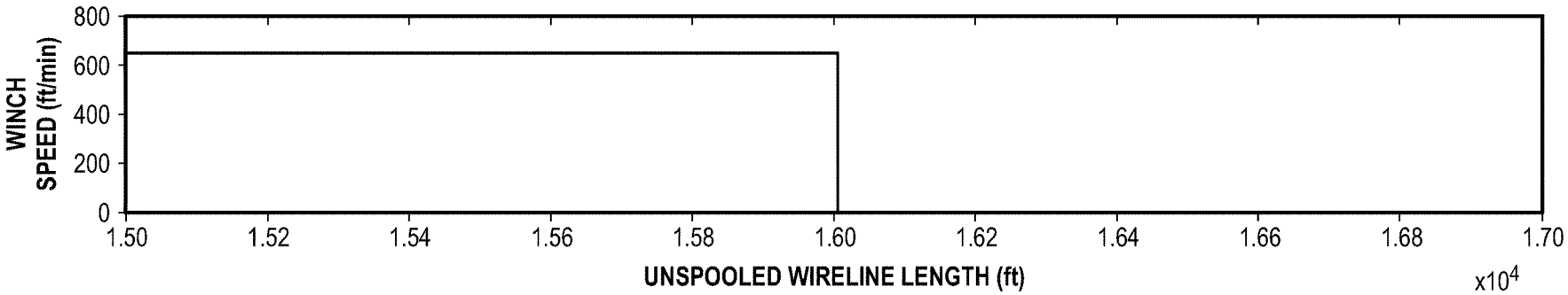
Figure 8C:
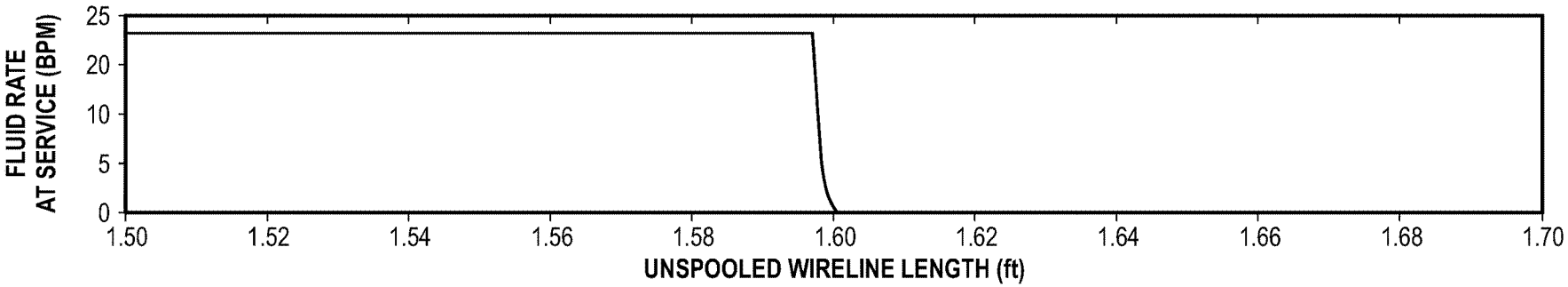

FIGS. 8*a* to 8*c* shows an example of an automated stop of a pump down operation according to embodiments of the present disclosure. The simulated wireline tension (in pound, lb) is displayed as a function of wireline length (in ft) in FIG. 8*a*. The simulated winch speed (in ft per minute) is shown as a function of wireline length in FIG. 8*b*. Finally, the simulated fluid rate measured at surface (in barrel per minute) is also displayed as a function of wireline length in FIG. 8*c*. In the simulation, the user inputs a stop target depth 504 of 16,000 ft (4886 m) and uses the wireline length or unspooled wireline length to estimate the actual depth of downhole tool string 160. It should be noted that the proposed algorithm reduces fluid rate at surface to zero slightly before reaching 16,000 ft (4886 m) to compensate for the delay time of the fluid traveling from surface to downhole.

Figure 9A:
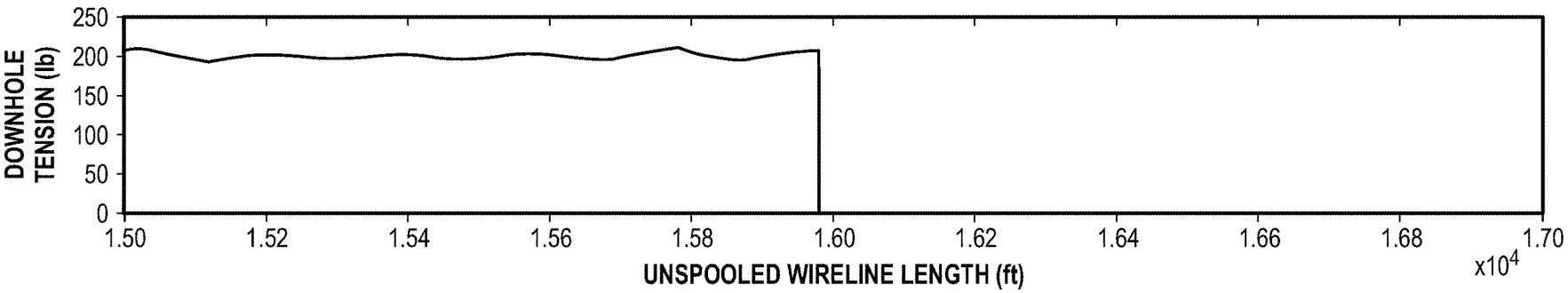
FIGS. 9*a* to 9*c* shows an example of an automated stop of a pump down operation with an early stop.
Figure 9B:
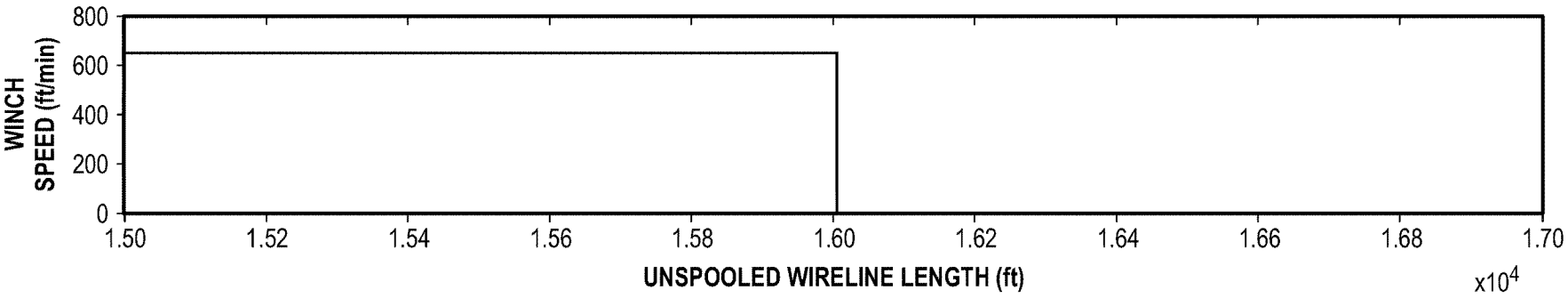
Figure 9C:
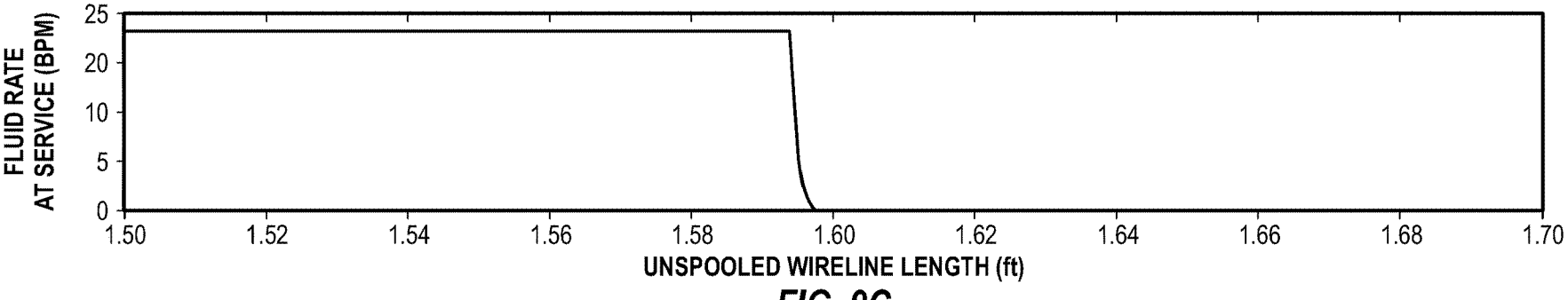

FIGS. 9*a* to 9*c* shows an example of an automated stop of a pump down operation with an early stop. The simulated wireline tension (in pound, lb) is displayed as a function of wireline length (in ft) in FIG. 9*a*. The simulated winch speed (in ft per minute) is shown as a function of wireline length in FIG. 9*b*. Finally, the simulated fluid rate measured at surface (in barrel per minute) is also displayed as a function of wireline length in FIG. 9*c*. In the simulation, the pump unit reduces the fluid rate too early, and the downhole tension drops to zero before the winch unit stops at 16,000 ft (4886 m). Although the unspooled wireline length is 16,000 ft (4886 m), the low downhole tension suggests the downhole string physically stops before 16,000 ft (4886 m) and the wireline slacks. In this case, the downhole tool may miss the target depth for the next operation, such as placing a plug or perforation of the casing. To avoid that, the user must restart the pump down operation to convey the downhole tool string 160 to target depth 504, increasing the cost and time to complete the whole operation.

Figure 10A:
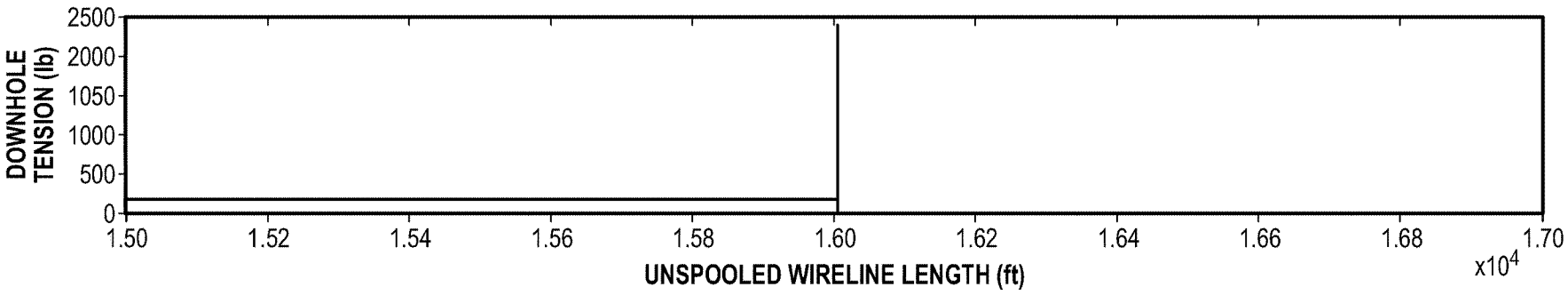
FIGS. 10*a* to 10*c* shows an example of an automated stop of a pump down operation with a late stop.
Figure 10B:
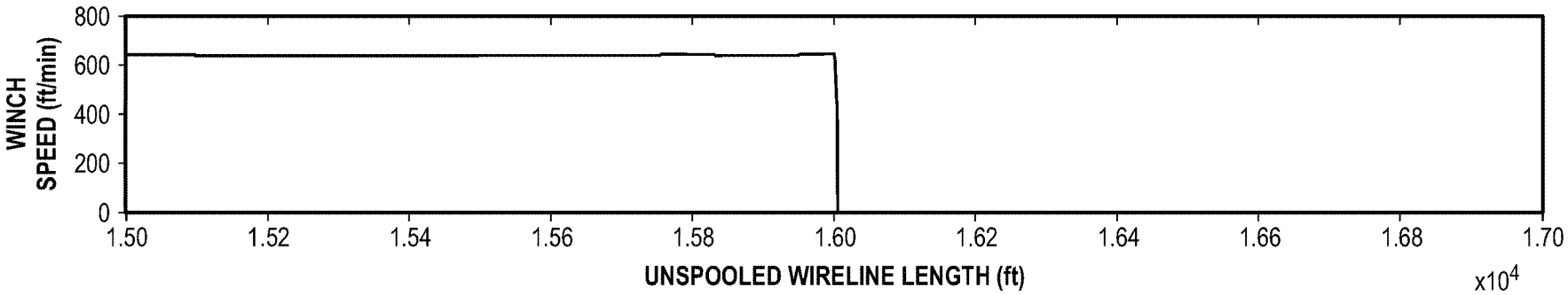
Figure 10C:
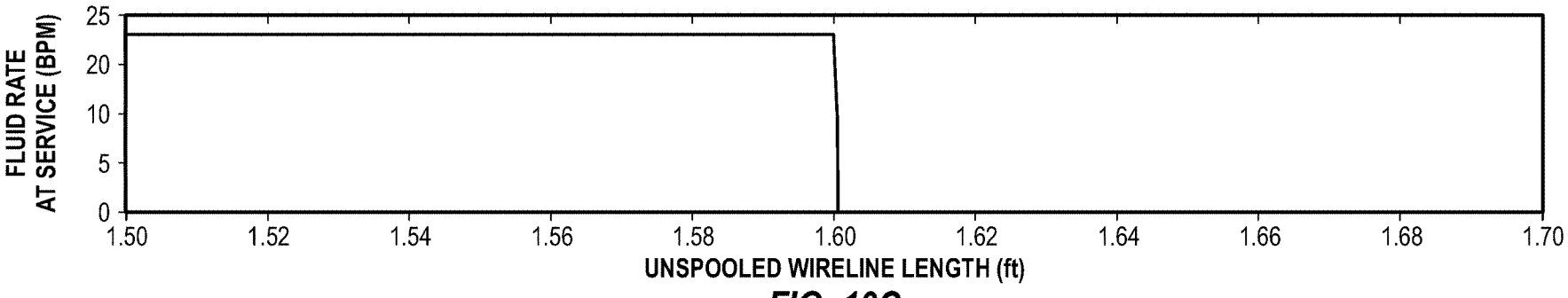

FIGS. 10*a* to 10*c* shows an example of an automated stop of a pump down operation with a late stop. The simulated wireline tension (in pound, lb) is displayed as a function of wireline length (in ft) in FIG. 10*a*. The simulated winch speed (in ft per minute) is shown as a function of wireline length in FIG. 10*b*. Finally, the simulated fluid rate measured at surface (in barrel per minute) is also displayed as a function of wireline length in FIG. 10(*c*). In a late stop, the fluid rate changes to zero at 16,000 ft (4886 m) rather than slightly earlier. Due to the uncompensated time delay of fluid traveling down the wellbore, the fluid rate around downhole tool string 160 is still high when the winch unit is stopped and downhole tool string 160 is stopped by the wireline. A large downhole wireline tension spike is generated that can damage the wireline or downhole tool string 160. In order to precisely stop at target depth 504, the wireline must be tightened beforehand so that the unspooled wireline length is close to the actual depth of downhole tool string 160.

Therefore, the automated stop of pump down operation requires to maintain the wireline tension before the winch unit is stopped. As shown in FIG. 8*a*, the wireline tension is maintained before the winch unit is stopped at 16,000 ft (4886 m). If the pump unit 122 reduces the fluid rate too early, as shown in FIG. 9*c*, the downhole wireline tension drops to zero before the winch unit stops at 16,000 ft (4886 m), as shown in FIG. 9*a*. Although the unspooled wireline length is 16,000 ft (4886 m) in FIG. 9*a*, the low downhole wireline tension suggests downhole tool string 160 physically stops before the 16,000 ft (4886 m) target depth 504 and wireline slacks, as shown in FIG. 9*a*. In this case, downhole tool string 160 may miss target depth 504 for the next operation, such as placing the plug and perforation.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A method for automating a pump-down stop operation of a downhole tool string comprising: measuring a depth of the downhole tool string, wherein the downhole tool string is held by a wireline; measuring a wireline tension; measuring a speed of the wireline; measuring a pumping rate; measuring an inclination of the downhole tool string; calculating a pump stop depth based on at least a target depth of the downhole tool string, total delay time of a pump unit, speed of the wireline, or any combination thereof; calculating a winch stop depth based on at least a target depth of the downhole tool string, total delay time of a winch unit, speed of the wireline, or any combination thereof; and stopping the downhole tool string at the target depth by regulating automatically a winch controller and a pump controller using the measurements of one or more of the depth, the calculated pump stop depth, the calculated winch stop depth, wireline tension, speed, pumping rate, and/or inclination.

2. The method of claim 1, wherein the winch controller controls the winch unit comprising the wireline, and the pump controller controls the pumping rate of the pump unit.

3. The method of claim 1, further measuring a speed of fluid traveling in the wellbore using one flow meter located at surface and another flow meter located on the downhole tool string; and calculating a delay time for a change of flow rate between a measured flow rate at surface and a measured flow rate on the downhole tool string with the same signature.

4. The method of claim 1, further measuring a speed of fluid traveling in the wellbore using one pressure sensor located at surface and another pressure sensor located on the downhole tool string; and calculating a delay time for a change of pressure between a measured pressure at surface and a measured pressure on the downhole tool string with the same signature.

5. The method of claim 1, wherein regulating automatically comprises processing received inputs, wherein the received inputs comprise at least one received input selected from the group consisting of the target depth, an actual depth, a response delay time of the pump unit, a response delay time of the winch unit, a wellbore pressure, a delay time of a fluid rate from surface to downhole, a wellbore inclination, data base of previous operations, and any combination thereof.

6. The method of claim 1, further measuring a depth of the downhole tool string and calculating a fluid rate delay time from surface to downhole by dividing a speed of sound in a wellbore fluid by the measured depth of the downhole tool string, wherein the downhole tool string is in contact with the wellbore fluid.

7. The method of claim 1, wherein calculating the pump stop depth comprises subtracting the product of total delay time of the pump unit and a current line speed to the target depth, wherein the total delay time comprises at least one delay time selected from the group consisting of response delay time of the pump unit, response delay time of the winch unit, response delay time of a fluid rate from surface to downhole, and any combination thereof.

8. The method of claim 1, further monitoring the method remotely.

9. The method of claim 8, wherein regulating automatically comprises processing different received inputs, wherein the different received inputs comprise at least two different received inputs selected from the group consisting of the target depth, an actual depth, a response delay time of the pump unit, a response delay time of the winch unit, a speed of a fluid traveling in a wellbore, a speed of sound in a wellbore fluid, a wellbore pressure, a delay time of a fluid rate from surface to downhole, a wellbore inclination, data base of previous operations, and any combination thereof.

10. The method of claim 1, wherein regulating automatically the winch controller and the pump controller in sequence to stop the downhole tool string at the target depth comprises calculating the pump stop depth and the winch stop depth separately and/or by including different received inputs.

11. The method of claim 1, regulating automatically the winch controller and the pump controller simultaneously to stop the downhole tool string at the target depth comprises maintaining the wireline tension within a safety range.

12. The method of claim 1, wherein the pump stop depth is calculated using the following equation:

$$\text{Depth}_{pump\ stop} = \text{Depth}_{target} - \left(T_{pump} + \frac{\text{Depth}_{actual}}{V_{sound\ in\ fluid}}\right) \times LSPD$$

wherein $\text{Depth}_{pump\ stop}$ is the depth for stopping the pump, $\text{Depth}_{target}$ is a target depth for stopping the tool string, $T_{pump}$ is a system delay time for commanding fluid rate target to fluid rate at surface reaches target, $\text{Depth}_{actual}$ is the actual depth of the downhole tool string, $V_{sound\ in\ fluid}$ is the speed of sound in wellbore fluid, LSPD is the fixed line speed after the tool string reaches pump stop depth.

13. The method of claim 1, wherein regulating automatically a winch controller and a pump controller is performed simultaneously to stop the downhole tool string at the target depth.

14. A method for automating a pump-down stop operation, comprising: measuring an actual depth of a downhole tool string in a wellbore; determining a position of the downhole tool string based at least on the actual depth with respect to a pump stop depth in the wellbore, wherein the pump stop depth is calculated by subtracting the product of a fixed line speed after the tool string reaches pump stop depth times the actual depth of the tool string to a target depth for stopping the tool string; reducing a fluid flow rate of a pump unit into the wellbore by outputting a fluid rate stop command to the pump unit in response to determining that the actual depth of the downhole tool string is greater than or equal to the pump stop depth; determining the position of the downhole tool string with respect to a winch stop depth in the wellbore; and reducing a line speed of a wireline connected to the tool string using a winch unit by outputting a line speed command to the winch unit in response to determining that the actual depth of the tool string is greater than or equal to the winch stop depth.

15. The method of claim 14, wherein the pump stop depth is calculated using the following equation:

$$\text{Depth}_{pump\ stop} = \text{Depth}_{target} - \left(T_{pump} + \frac{\text{Depth}_{actual}}{V_{sound\ in\ fluid}}\right) \times LSPD$$

wherein $\text{Depth}_{pump\ stop}$ is the depth for stopping the pump, $\text{Depth}_{target}$ is a target depth for stopping the tool string, $T_{pump}$ is a system delay time for commanding fluid rate target to fluid rate at surface reaches target, $\text{Depth}_{actual}$ is the actual depth of the downhole tool string, $V_{sound\ in\ fluid}$ is the speed of sound in wellbore fluid, LSPD is the fixed line speed after the tool string reaches pump stop depth.

16. A system for automating a pump-down stop operation, comprising:

a data logging and control truck;

a tool string attached to a wireline;

at least one cable tension sensing device;

a speed sensor device;

a control module calculating the pump stop depth, wherein the pump stop depth calculation comprises subtracting a product of total delay time of a pump unit and a current line speed to a target depth, wherein the total delay time comprises at least one delay time selected from the group consisting of response delay time of the pump unit, response delay time of a winch unit, response delay time of a fluid rate from surface to downhole and any combination thereof; and at least one computing device in communication with a pump controller and a winch controller, wherein the pump controller controls at least one pumping unit and the winch controller controls at least one winch unit, wherein the at least one computing device is configured to take user configuration parameters and measurement parameters as inputs to a control algorithm and output a line speed reference signal to the winch controller and a pump rate reference signal to the pump controller, wherein the at least one computing device comprises the control module.

17. The system of claim 16, wherein the user configuration parameters comprise at least one user configuration parameter selected from the group consisting of a recommended job speed, a value for downhole tension target in inclined section of a wellbore, a value for minimum downhole tension target, a tool string weight, a maximum available pump rate, a winch speed safe limit, and any combinations thereof, and wherein the measurement parameters comprise at least one measurement parameter selected from the group consisting of a measured speed of a fluid traveling in a wellbore, a measured depth of the tool string, a measured downhole cable tension, a measured cable line speed, a measured pump rate, a measured tool string inclination, and any combination thereof.

* * * * *